US009885152B2

(12) United States Patent
Schmid et al.

(10) Patent No.: US 9,885,152 B2
(45) Date of Patent: Feb. 6, 2018

(54) LARGE CYLINDER DRYING ROLLER AND METHOD FOR PRODUCING A LARGE CYLINDER DRYING ROLLER

(71) Applicant: VOITH PATENT GMBH, Heidenheim (DE)

(72) Inventors: Christian Schmid, Tettnang (DE); Robson Consolato, Sao Paulo (BR); Marco Brujas, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 50 days.

(21) Appl. No.: 14/902,883

(22) PCT Filed: Jun. 2, 2014

(86) PCT No.: PCT/EP2014/061332
§ 371 (c)(1),
(2) Date: Jan. 5, 2016

(87) PCT Pub. No.: WO2015/000648
PCT Pub. Date: Jan. 8, 2015

(65) Prior Publication Data

US 2016/0130758 A1 May 12, 2016

(30) Foreign Application Priority Data

Jul. 5, 2013 (DE) ..... 10 2013 213 188

(51) Int. Cl.
*D21F 5/02* (2006.01)

(52) U.S. Cl.
CPC ..... *D21F 5/021* (2013.01)

(58) Field of Classification Search
CPC ..... D21F 5/022; D21F 5/024; D21F 5/025; D21F 5/027; D21F 5/028; D21F 5/08
USPC ..... 492/39, 46, 58, 60
See application file for complete search history.

(56) References Cited

U.S. PATENT DOCUMENTS 2,328,321 A 8/1943 Berry
3,052,039 A * 9/1962 Johnson ..... B21D 51/00 15/256.5
3,061,944 A 11/1962 Kraus et al.
3,116,985 A 1/1964 Kraus
3,118,743 A * 1/1964 Malmstrom ..... D21F 5/02 34/110
3,224,084 A * 12/1965 Johnson ..... B21D 51/00 138/154
3,241,251 A * 3/1966 Justus ..... F26B 13/183 34/124
3,258,851 A 7/1966 Vonderau
(Continued)

FOREIGN PATENT DOCUMENTS

CN 101641475 A 2/2010
CN 102234953 A 11/2011
(Continued)

*Primary Examiner* — Jason L Vaughan
(74) *Attorney, Agent, or Firm* — Laurence A. Greenberg; Werner H. Stemer; Ralph E. Locher

(57) ABSTRACT

A large-cylinder drying roller is provided with a divided hollow shaft for reasons of production. The divided hollow shaft has hollow-shaft parts which are capable of being inserted at both sides into a construction composed of a cylinder shell and caps connected thereto by a weld seam, and are capable of being thereafter connected to one another and to the caps.

6 Claims, 4 Drawing Sheets

(56) References Cited

U.S. PATENT DOCUMENTS

| | | | | | |
|---|---|---|---|---|---|
| 3,299,530 | A | * | 1/1967 | Eiss | D21F 5/10 165/90 |
| 3,299,531 | A | * | 1/1967 | Kutchera | D21F 5/02 165/90 |
| 3,359,647 | A | * | 12/1967 | Webb | D21F 5/10 165/89 |
| 3,633,662 | A | * | 1/1972 | Voll | D06C 15/08 165/89 |
| 3,808,700 | A | * | 5/1974 | Kraus | D21F 5/02 165/89 |
| 4,320,582 | A | | 3/1982 | Klippstein et al. | |
| 4,878,299 | A | * | 11/1989 | Wedel | F26B 13/183 34/108 |
| 8,438,752 | B2 | | 5/2013 | Mennucci et al. | |
| 8,919,008 | B2 | | 12/2014 | Bauboeck et al. | |
| 2010/0132903 | A1 | | 6/2010 | Mennucci et al. | |
| 2014/0068961 | A1 | | 3/2014 | Bauboeck et al. | |

FOREIGN PATENT DOCUMENTS

| | | | |
|---|---|---|---|
| DE | 202007019227 | U1 | 5/2011 |
| EP | 2385171 | A1 | 11/2011 |
| EP | 2385171 | B1 | 9/2012 |

* cited by examiner

LARGE CYLINDER DRYING ROLLER AND METHOD FOR PRODUCING A LARGE CYLINDER DRYING ROLLER

BACKGROUND OF THE INVENTION

Field of the Invention

The invention relates to a large-cylinder drying roller, at least composed of a cylindrical cylinder shell, of two caps which are attached on both sides of the cylinder shell, of an inner shaft which is coaxially disposed within the cylinder shell, and of two journals which are provided indirectly by way of the inner shaft which is connected to the caps or are provided directly on the caps. The invention also relates to a method for manufacturing a large-cylinder drying roller of this type, in which method initially the cylinder shell and the caps are interconnected and subsequently the inner shaft is inserted and is connected to the caps.

Large-cylinder drying rollers of this type have been disclosed in EP 2 385 171 B1 or in U.S. Pat. No. 3,061,944, for example, wherein these rollers, depending on their application, are generally called Yankee rollers in the production of tissue paper or sanitary paper or soft paper, MG (machine glazed) rollers in the production of machine-smoothed paper, or drying cylinders in the production of cardboard-type and art paper. Corresponding large-cylinder drying rollers may be heated, for example by water vapor which is introduced into the large-cylinder drying roller. It is to be understood that other energy sources may be used in this context, depending on the specific implementation.

In the case of large-cylinder drying rollers of this type a compromise has to be accepted here between strength, in particular in relation to the connection between the caps and the cylinder shell, and production facilities, since true running has to be ensured in particular even subsequent to any welding work, whereby it has to be considered that large-cylinder drying rollers of this type have cylinder diameters of 5 m and more, and cylinder widths of 7 m and more, and the masses of cylinders of this type may easily exceed 90 t.

In the context of this compromise it is proposed by EP 2 385 171 B1 to initially connect, preferably weld, the cylinder shell to the two caps, since the interior of the large-cylinder drying roller is still readily accessible and also corresponding works in the interior are easy to perform. Only thereafter is the one-piece inner shaft inserted through openings of the caps into the construction composed of the caps and the cylinder shell and connected to the caps.

BRIEF SUMMARY OF THE INVENTION

It is an object of the present invention to provide a construction of this type of large-cylinder drying rollers that is optimized in terms of production, function, and costs.

In order to achieve the object, a large-cylinder drying roller is at least composed of a cylindrical cylinder shell, two caps which are attached on both sides of the cylinder shell, an inner shaft which is coaxially disposed within the cylinder shell, and two journals which are provided indirectly by way of the inner shaft which is connected to the caps or are provided directly on the caps. In order to achieve the object, additionally a method for manufacturing a large-cylinder drying roller at least composed of a cylindrical cylinder shell, two caps which are attached on both sides of the cylinder shell, an inner shaft which is coaxially disposed within the cylinder shell, and two journals which are provided indirectly by way of the inner shaft which is connected to the caps or are provided directly on the caps, initially includes interconnecting the cylinder shell and the caps and subsequently inserting and connecting the inner shaft to the caps. Further advantageous design embodiments are to be found in the dependent claims and in the following description.

This solution is based on the common inventive concept of initially pre-fabricating the large-cylinder drying roller in small functional units which, however, are as complete as possible and which are substantially subjected to in each case individual and uniform manufacturing steps and of connecting said functional units only thereafter. In this way, a construction composed of a cylinder shell and caps may be mechanically processed in a separate manner and also be heat treated. Likewise, hollow-shaft parts may be prepared in comparatively small functional units prior to the entire large-cylinder drying roller being assembled.

In this way, a construction which is optimized in terms of production, function, and costs results when in the case of a method for manufacturing a large-cylinder drying roller, which is at least composed of a cylindrical cylinder shell, of two caps which are attached on both sides of the cylinder shell, of an inner shaft which is coaxially disposed within the cylinder shell, and of two journals which are provided indirectly by way of the inner shaft which is connected to the caps or are provided directly on the caps, initially the cylinder shell and the caps are interconnected and subsequently the inner shaft is inserted and is connected to the caps, wherein the inner shaft is configured so as to be divided and for insertion in each case one inner-shaft part is inserted from both sides and then the inner shaft is connected together and to the caps. By contrast to the procedural method illustrated in EP 2 385 171 B1, here the advantage is achieved that not the entire inner shaft across its entire length has to be guided through the entire large-cylinder drying roller, this per se requiring a lot of space and being extremely complex in terms of production technology.

This method management is particularly advantageous when the inner shaft is a divided hollow shaft, as is often the case with large-cylinder drying rollers. Accordingly, a construction which is optimized in terms of production, function, and costs results when a large-cylinder drying roller which is at least composed of a cylindrical cylinder shell, of two caps which are attached on both sides of the cylinder shell, of an inner shaft which is coaxially disposed within the cylinder shell, and of two journals which are provided indirectly by way of the inner shaft which is connected to the caps or are provided directly on the caps, is characterized in that the inner shaft is a hollow shaft which is divided into at least two hollow-shaft parts and the two hollow-shaft parts are interconnected or interconnectable, respectively, by way of a hollow-shaft connection which is accessible from the interior of the hollow shaft. A design embodiment of this type enables the divided hollow shaft to be connected working from the interior out to form a hollow shaft, this being significantly more simple in terms of construction and/or production technology than in the case where a connection of this type has to be closed from the outside prior to the hollow shaft being able to be inserted into the construction composed of the caps and the cylinder shell.

To this extent it is also advantageous in terms of procedural reasons of the method when the two hollow-shaft parts are connected by a hollow-shaft connection which radially lies in the interior of the hollow shaft, and the hollow-shaft connection is closed after insertion of the two hollow-shaft parts of the hollow shaft.

Accordingly, a construction which is optimized in terms of production, function, and costs also results when a large-cylinder drying roller, at least composed of a cylindrical cylinder shell, of two caps which are attached on both sides of the cylinder shell, of an inner shaft which is coaxially disposed within the cylinder shell, and of two journals which are provided indirectly by way of the inner shaft which is connected to the caps or are provided directly on the caps, is characterized in that the inner shaft is a hollow shaft which is divided into at least two hollow-shaft parts, and the two hollow-shaft parts of the hollow shaft in each case on that axial side thereof that is opposite the hollow-shaft connection have a cap-connection flange for use with one of the caps, and all functional groups of a part-portion of a hollow-shaft part that is disposed within the cylinder shell are radially disposed within an axially extending part-cylinder which is defined by the cap-connection flange, and/or all functional groups of a portion of the hollow shaft that is disposed within the cylinder shell are radially disposed within an axially extending cylinder which is defined by the two cap-connection flanges. A design embodiment of this type ensures that the two hollow-shaft parts may be readily inserted from both sides into the caps which are already connected to the cylinder shell. It is to be understood that, depending on the specific design embodiment of the large-cylinder drying roller, installed parts, such as condensate pipelines, nozzles, or similar connections, may be retro-fitted in the hollow shaft or else in the space between the cylinder shell and the hollow shaft and/or the inner shaft.

A construction which is optimized in terms of production, function, and costs also results when a method for manufacturing a large-cylinder drying roller which is at least composed of a cylindrical cylinder shell, of two caps which are attached on both sides of the cylinder shell, of an inner shaft which is coaxially disposed within the cylinder shell, and of two journals which are provided indirectly by way of the inner shaft which is connected to the caps or are provided directly on the caps, in which method initially the cylinder shell and the caps are interconnected and subsequently the inner shaft is inserted and is connected to the caps, are characterized in that prior to the inner shaft being inserted the cylinder shell and the caps are stress-relieved, their connection checked from the inside, and/or are mechanically processed together. On account thereof that these method steps are performed individually or collectively prior to the inner shaft being inserted, there is sufficient space for the respective activities to be performed also in the interior. Moreover, all procedures which introduce high amounts of energy into the caps and the cylinder shell, such as annealing and welding operations, for example, may be completed prior to mechanical processing and in particular do not affect functional groups which are not required to be subjected to corresponding works. This causes excellent true running properties and dimensional accuracy, since no more weld seams have to be introduced after mechanical processing. Depending on the specific method management, all weld seams moreover may be mechanically processed so that the quality of the weld seams may be set to a higher level in computations. The risk of tension cracks in weld seams or in the zone that is influenced by welding, respectively, may also be reduced, the possibility for checking to be performed from the interior being accordingly advantageous. On account of this procedure, in particular functional groups, such as the inner-shaft parts on the one hand, and the construction composed of the cylinder shell and caps on the other hand, for example, do not obstruct any works on the respective other functional groups.

After inserting the inner shaft, the drying roller is advantageously not annealed any more until being commissioned, so that the corresponding dimensional accuracy is maintained. Likewise, comparatively extensive welding works which require a significant introduction of energy are preferably no longer performed. It is to be understood that welding works in radially inner regions as well as spot welding or tack welding may still be readily carried out since and/or if such welding does not have a disadvantageous effect on the true running properties.

In specific design embodiments, the journals may be configured so as to be integral with the caps, for example. However, this will typically be the case only with comparatively small large-cylinder drying rollers. It is likewise conceivable for the journals to be configured so as to be integral with the hollow shaft, such as is disclosed in an exemplary manner in EP 2 385 171 B1 or in U.S. Pat. No. 3,061,944, respectively. The journals may also be attached to the caps as separate functional groups, such as is likewise illustrated as being prior art in EP 2 385 171 B1.

However, at least one of the hollow-shaft parts is preferably closed off by a journal, so that activities in the interior of the hollow shaft, such as closing the hollow-shaft connection after the hollow-shaft parts have been inserted, are readily possible.

Accordingly it is advantageous for the manufacturing method when the two hollow-shaft parts of the hollow shaft are closed after closing of the hollow-shaft connection, for example in that the journals are connected to the hollow-shaft parts.

As has already been explained above, it is advantageous on the other hand for stress-relieving or relaxing annealing, respectively, checking of the connection between the cylinder shell and the caps, and/or mechanical processing thereof, to be performed prior to the inner shaft or the hollow shaft, respectively, being inserted. On account thereof, there remains in particular sufficient space for mechanical processing and/or checking of the connection between the caps and the cylinder shell to be able to be performed through the central cap and/or hollow-shaft openings. It is in particular possible for mechanical machining centers to be inserted into the interior of the cylinder shell openings, such that mechanical processing may be performed in a correspondingly precise manner. The same applies to testing apparatus which may be readily placed through these openings into the interior of the cylinder shell so that checks of this type may be carried out in a correspondingly precise and complex manner.

It is to be understood that after insertion of the inner shaft functional groups may still be attached in the interior of the cylinder shell and/or to the inner shaft or within the hollow shaft, respectively. This applies, for example, to condensate outlet lines or to vapor nozzles and other structures. Functional groups of this type, however, are comparatively delicate and easy to handle, so that this activity may also readily be performed when the inner shaft has been inserted.

The connection between the cylinder shell and the caps is preferably welded, in particular by way of an annular weld seam comprising a plurality of weld beads. A weld seam of this type is highly resilient and dimensionally stable, on the one hand. Moreover, said weld seam is also tight, provided that the former may be tested in a suitable manner, this being of advantage in particular when the large-cylinder drying roller is pressurized. A corresponding weld seam also readily withstands thermal stress.

It is to be understood that other connections which are provided on the large-cylinder drying roller may also be welded. However, connections which have to be opened for maintenance purposes are preferably screwed.

Accordingly, it is advantageous for the connection of the two inner-shaft parts or hollow-shaft parts, respectively, to be performed by screwing.

A well-stabilized connection, and accordingly a well-stabilized hollow-shaft, results when at least one of the hollow-shaft parts has an inner wall which is a component part of the hollow-shaft connection. An inner wall of this type may in particular be oriented so as to be perpendicular to the main axis of the large-cylinder drying roller and optionally also constitute a delimiting wall which in the interior mutually separates the two hollow-shaft parts, so that the one hollow-shaft side may be used as an inlet for an energy carrier, such as steam, for example, and the other hollow-shaft side may be used as an outlet.

Preferably, at least one of the caps has a radial extent, extending from the radial inner side of said cap up to the radial outer side of said cap, of between 600 mm and 1100 mm, preferably between 650 mm and 1000 mm. In the case of a given radius of the cylindrical cylinder shell, this requires a cap opening which is as large as possible and through which corresponding processing and checking work in the interior of the construction composed of the cylinder shell and the cap may be carried out in a simple and operationally safe manner, without the cap having an extent which is insufficient for necessary functional groups, such as for example optionally included manholes. Moreover, an extent having these dimensions requires an inner or hollow shaft, respectively, which is as large as possible, this increasing the rigidity of the large-cylinder drying roller and thus the dimensions of true running and also the inherent rigidity of the caps. Depending on the specific situation a correspondingly lower number of solid functional groups may be employed.

In certain circumstances a manhole may also be provided in a cap-connection flange by means of which the hollow shaft is connected to one of the caps, so that access into the large-cylinder drying roller is possible therethrough. This is of particular advantage when for whatever reasons there is not enough remaining space for a manhole in the cap. Additionally or alternatively, a manhole may also be provided in an inner wall of the hollow shaft, so that it is possible to make one's way from one hollow-shaft part to another part. It is accordingly advantageous for a manhole to be provided in at least one axial wall of the hollow shaft, that is to say in a cap-connection flange or in an inner wall, for example, or in any other axial wall of the hollow shaft. Optionally, at least one manhole may also be additionally provided in walls of the hollow shaft which point to the cylinder shell, that is to say for example in cylindrical walls of the hollow shaft, so as to also reach the interior of the cylinder shell from the hollow shaft, or vice versa.

It is to be understood that the features of the solutions which have been described above or in the claims, respectively, may optionally also be combined with one another so as to be able to correspondingly implement the advantages in a cumulative manner.

BRIEF DESCRIPTION OF THE SEVERAL VIEWS OF THE DRAWING

Further advantages, objectives, and properties of the present invention will be explained by means of the following description of exemplary embodiments which in particular are also illustrated in the appended drawing, in which.

DESCRIPTION OF THE INVENTION

Figure 1:
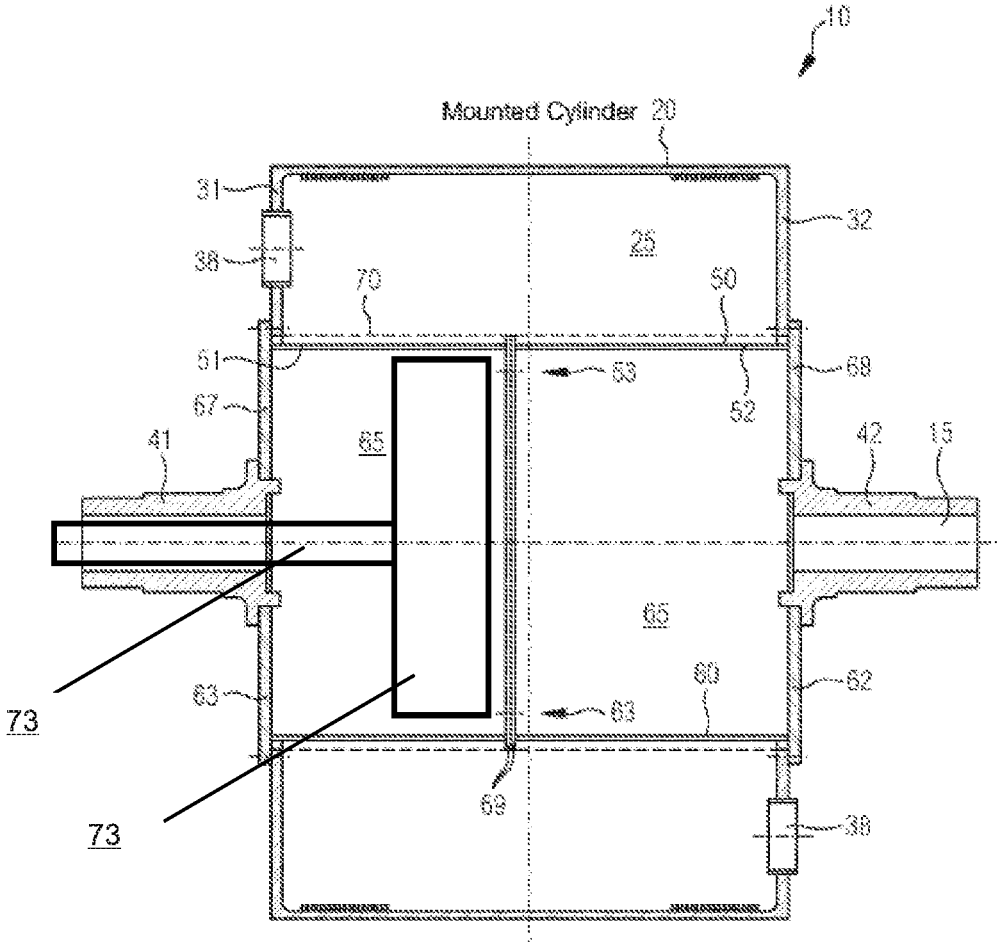
FIG. 1 schematically shows a section through a large-cylinder drying roller, along the line I-I in FIG. 2.
Figure 2:
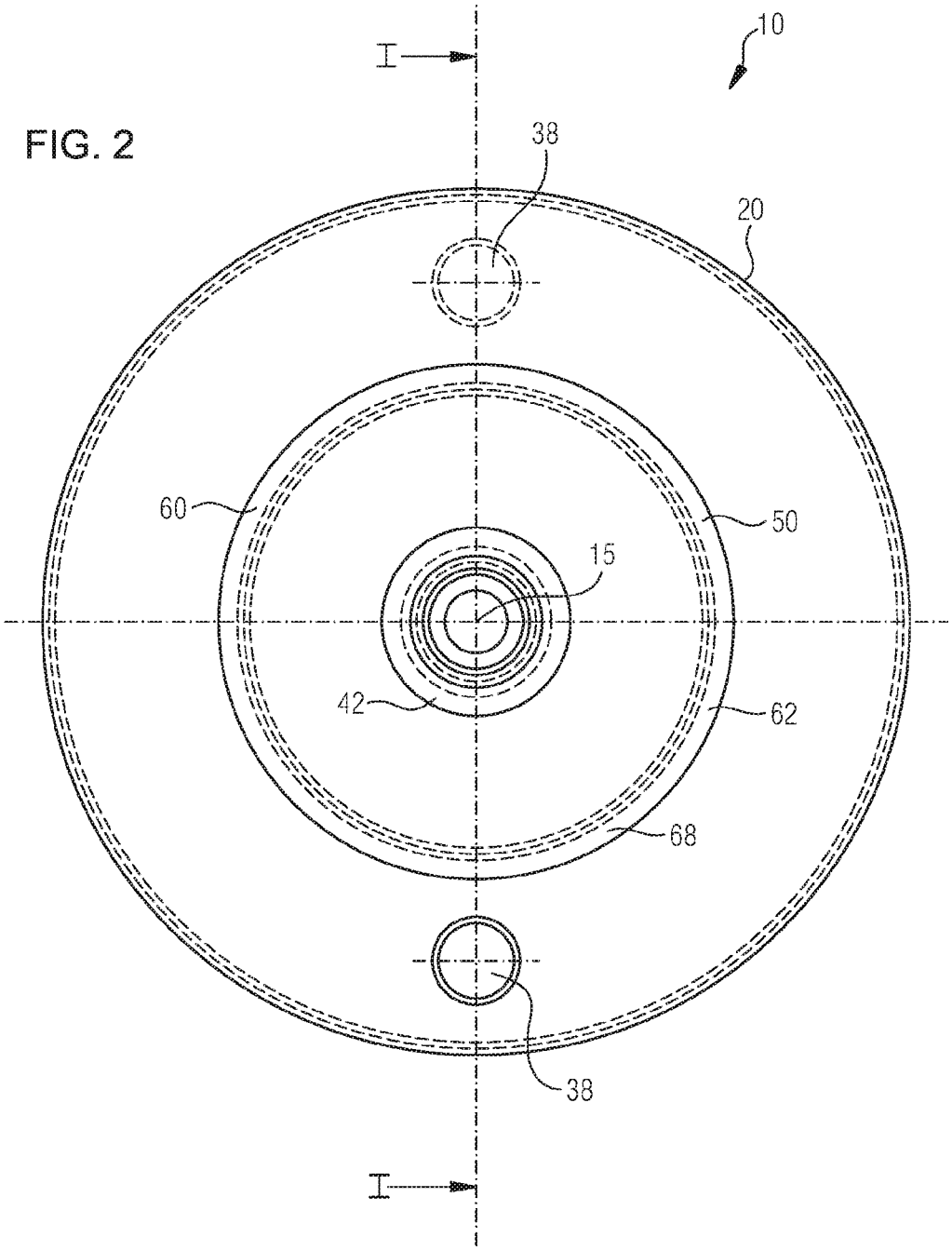
FIG. 2 shows the drying roller according to FIG. 1 in a side view.

Large-cylinder drying roller 10 illustrated in the figures is composed of a cylindrical cylinder shell 20, two caps 31, 32 which are attached to both sides of the cylinder shell, an inner shaft 50 which is coaxially disposed within the cylinder shell 20, and two journals 41, 42 which are provided on the inner shaft 50 which in turn is connected to the caps 31, 32.

Figure 4:
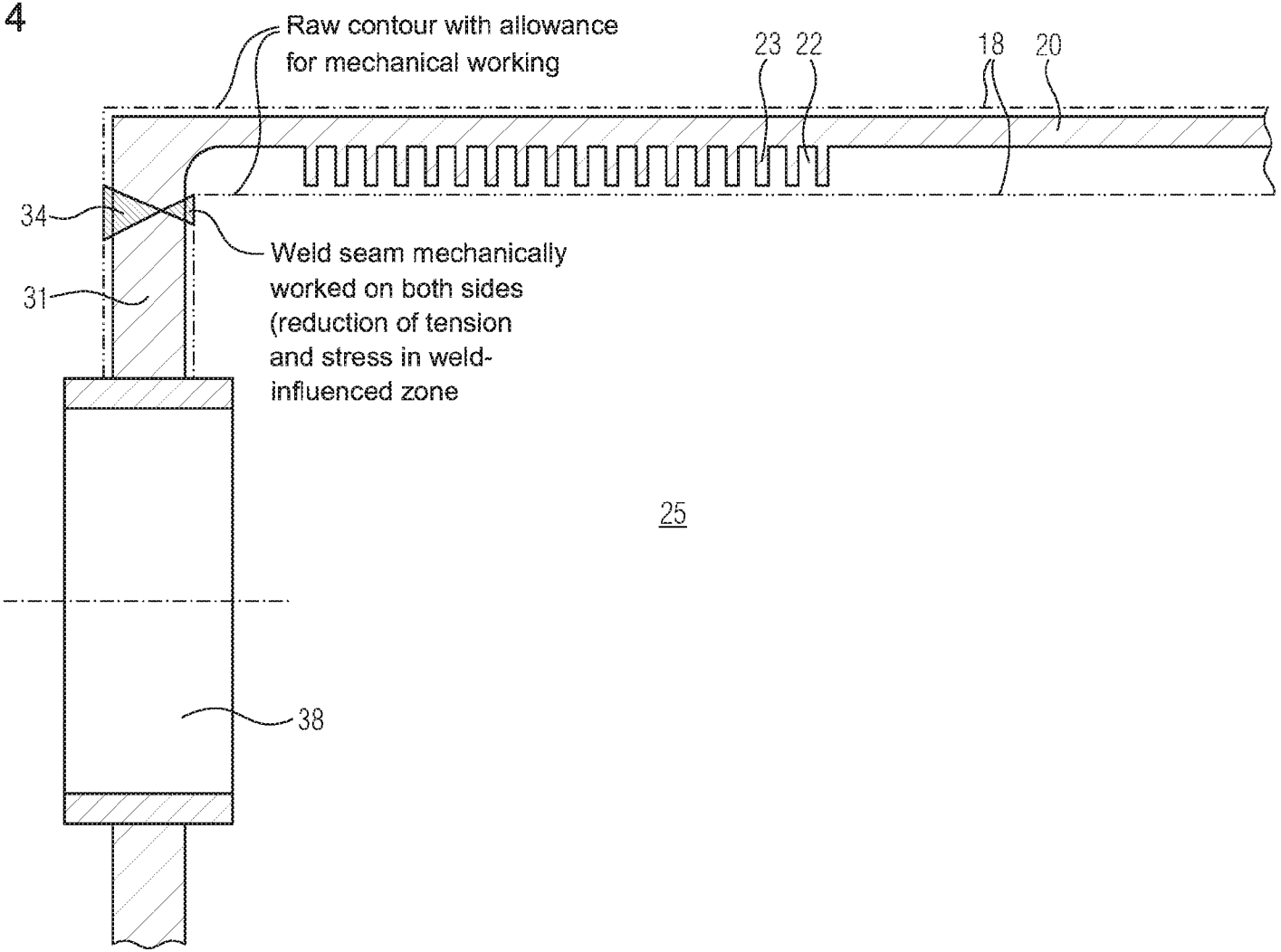
FIG. 4 shows an enlargement of the detail IV in FIG. 3.

The caps 31, 32 here are in each case welded to the cylinder shell 20, as can be seen in particular in FIG. 4, wherein in this exemplary embodiment a weld seam 34 which is mechanically processed on both sides is provided, on account of which tensions and stress concentrations in the zone which is influenced by welding may be minimized.

The cylinder shell 20 moreover has grooves 22 and webs 23 which are known per se and by way of which condensate is selectively trapped in a manner known per se and may be evacuated by way of assemblies which are known per se but not illustrated here.

In the present exemplary embodiment the weld seam 34 lies between the caps 31, 32 and the cylinder shell 20, in a region between the caps 31, 32 and the cylinder shell 20 that extends in a perpendicular manner to the roller axis 15, wherein other design embodiments of the transition between the caps 31, 32 and the cylinder shell 20 are also conceivable or are already known from the prior art, respectively, for example also in a region which is provided to be perpendicular to the former region as a region which extends parallel with the roller axis 15, without the advantages in terms of the manufacturing and the specific design embodiment of the large-cylinder drying roller 10 as explained above and in the following being compromised thereby.

Manholes 38, which are already known per se, through which the interior 25 of the cylinder shell 20 may be reached even after assembly of the large-cylinder drying roller 10, are provided in the caps 31, 32. Manholes for getting to the interior 65 of the hollow shaft 60 may optionally also be provided in the cylindrical wall of the inner shaft 50 when the inner shaft 50 as in the present exemplary embodiment is configured as a hollow shaft 60. Manholes of this type may be provided for example on cap-connection flanges 67, 68 of the hollow shaft 60 or else also in the cylindrical wall of the hollow shaft 60. It is likewise conceivable for a manhole of this type to be provided on an inner wall 69 of the hollow shaft 60 when the hollow shaft 60, as in this exemplary embodiment, or the inner shaft 50, respectively, is divided into two hollow-shaft parts 61, 62, or inner-shaft parts 51, 52, respectively.

In the present exemplary embodiment, separate holes by way of which the interior 65 of the hollow shaft 60 may be reached are not required per se, since in this exemplary embodiment the journals 41, 42 in each case close central hollow-shaft openings 64 which are in each case disposed in the cap-connection flanges 67, 68, so that the interior 65 of the hollow shaft 60 may be reached through the central hollow-shaft openings 64. The latter is difficult when the journals 41, 42 have been inserted and the large-cylinder drying roller 10 is mounted in its bearings, as this would mean a complete removal. To this end, separate manholes which not only enable access to the interior 65 of the hollow shaft 60 or of the respective hollow-shaft part 61, 62, but also access to the interior 25 of the cylinder shell 20 and of the 65 of the other hollow-shaft parts 61, 62, when further manholes are provided in the walls of the hollow shaft 60 or of the hollow-shaft parts 61, 62, for example in the cylindrical wall or the inner walls 69, may also be provided in the cap-connection flanges 67, 68.

Both caps 31, 32 in the present exemplary embodiment have in each case one radial inner side 35 and radial outer side 36 which are mutually spaced apart by an extent H. The extent H in this exemplary embodiment is selected to be 800 mm, so that the manholes 38 may be configured to be of sufficient size. The extent H also in other exemplary embodiments is preferably selected to be between 900 mm and 700 mm, so that here too sufficient space remains for manholes 38 and it is ensured that the radius of the respective central cap opening 37 of the caps 31, 32 remains sufficiently large for machine parts, mechanical machining centers, and testing installations to be able to be brought into the interior 25 of the cylinder shell 20 in an operationally safe manner, so as for the necessary tasks to be able to be completed in an operationally safe manner also working from the inside out, or on the inner side of the construction composed of the cylinder shell 20 and the caps 31, 32, respectively.

Figure 3:
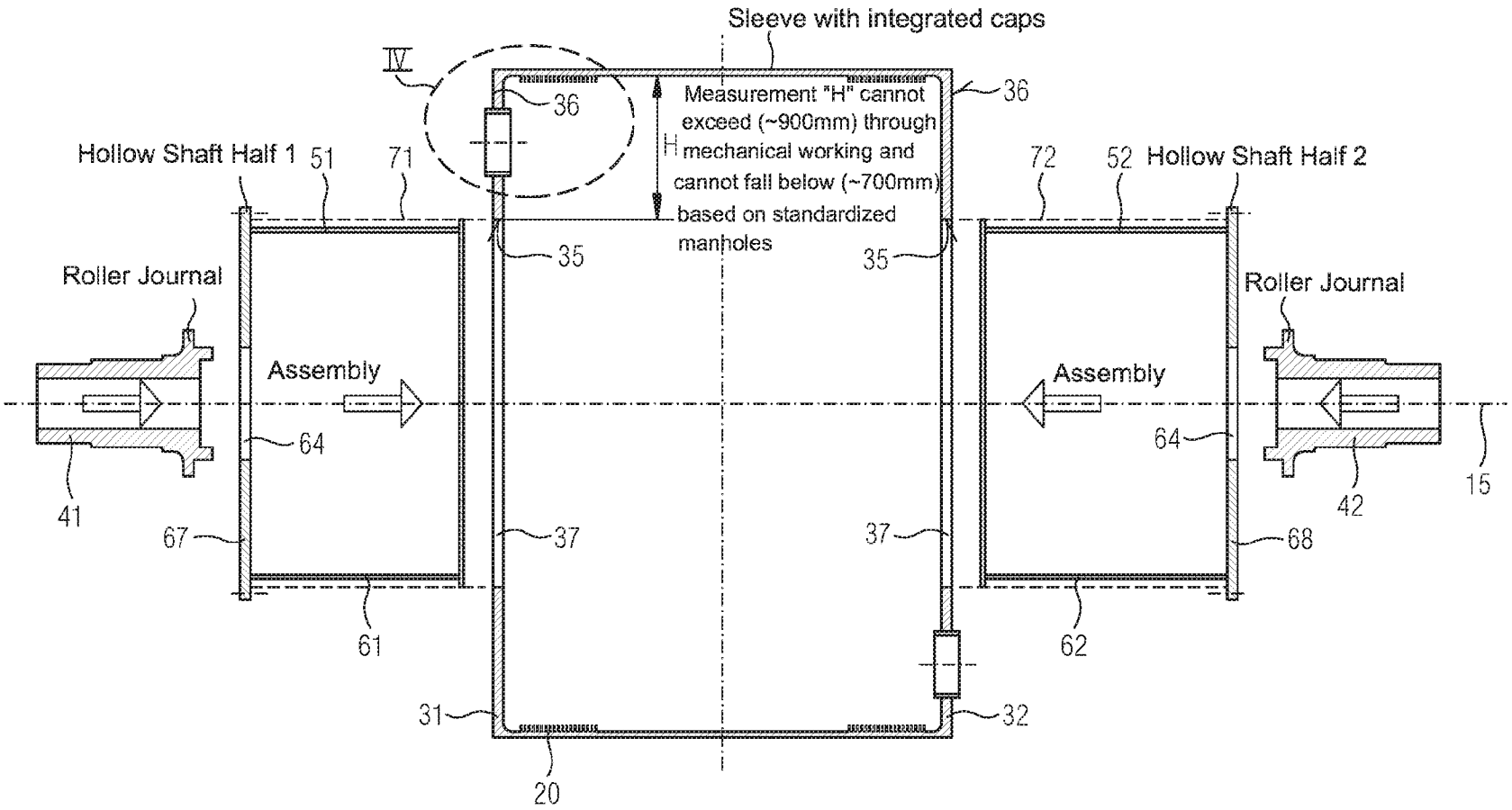
FIG. 3 shows the large-cylinder drying roller according to FIGS. 1 and 2, prior to the inner shaft being inserted.

In order for the large-cylinder drying roller 10 to be manufactured, the functional groups which are separately illustrated in FIG. 3 are initially provided separately. In particular, the caps 31, 32 are initially connected to the cylinder shell 20.

Subsequently thereto, mechanical processing of the raw-state contour 18 composed of the caps 31, 32 and the cylinder shell 20 takes place (cf. FIG. 4), in that the material of the raw-state contour 18 is subtracted by suitable mechanical machines, and the construction composed of the cylinder shell 20 and the caps 31, 32 is mechanically shaped. In this method step, in particular the grooves 22 and the webs 23 and optionally other mechanical design features are machined from the raw-state contour 18. The surface of the cylinder shell 20 is likewise processed to a corresponding dimension in terms of its circularity. Moreover, the weld seam 34 is mechanically processed on both sides, as has been explained above.

Depending on the specific method management, annealing of the entire construction is performed prior to mechanical processing, so that any warping or the consequences thereof may be removed by mechanical processing. As long as the hollow shaft 60 has not been inserted, checking of the weld seams 34 and of further parameters may likewise be readily performed. It is also conceivable for complementary functional groups to be incorporated in the interior 25 of the cylinder shell 20 at this point in time.

Subsequent thereto, the two hollow-shaft parts 61, 62 are introduced from both sides in each case into the construction composed of the cylinder shell 20 and the caps 31, 32, wherein for this purpose all functional groups 73 of the hollow shaft 60 or of the hollow-shaft parts 61, 62 are disposed so as to be radially within part-cylinders 71, 72 which are defined by the respective cap-connection flanges 67, 68 (cf. FIG. 3) or radially within a cylinder 70 which is defined by the two cap-connection flanges 67, 68 (cf. FIG. 1), so that insertion may be readily performed. Any functional groups which are connected to the hollow-shaft parts 61, 62 and radially protrude beyond the part-cylinders 71, 72, or beyond the cylinder 70, respectively, may optionally be retro-fitted after the hollow-shaft parts 61, 62 have been inserted.

As has already been explained, each hollow-shaft part 61, 62 has an inner wall 69 which are axially disposed in the interior 25 of the cylinder shell 20 and constitute parts of a hollow-shaft connection 63 or of an inner-shaft connection 53 in that the inner walls 69 of the two hollow-shaft parts 61, 62 for connecting the hollow-shaft parts 61, 62, or the inner-shaft parts 51, 52, respectively, are interconnected by way of connection elements which in this exemplary embodiment are screws.

After insertion the cap-connection flanges 67, 68 are also connected to the caps 31, 32, this in the case of this exemplary embodiment likewise being performed by screws.

The interior 65 of the hollow shaft 60 may still be reached through the central hollow-shaft opening 64, in order for the hollow-shaft connection 63 or the inner-shaft connection 53, respectively, to be manipulated, on the one hand, or for other constructive measures to be performed there, on the other hand.

Subsequently thereto, the journals 41, 42 are inserted into the central hollow-shaft opening 64 so that the hollow shaft 60 is closed off on account thereof. The journals 41, 42, in a manner known per se, are configured so as to be hollow so that by way of the latter the interior 65 of the hollow shaft 60 may be reached in a manner known per se.

In the case of this exemplary embodiment the journals 41, 42 are likewise screwed to the cap-connection flanges 67, 68, wherein in a modified embodiment it is conceivable here for a weld connection, for example spot welding or else an encircling weld connection, to be provided, since the total introduction of energy at this point if and when applicable may be sufficiently controlled and any distortion worth mentioning is not to be expected here under certain circumstances. Other types of connections are likewise conceivable at this point.

LIST OF REFERENCE SIGNS

10 Large-cylinder drying roller
15 Roller axis
18 Raw-state contour
20 Cylinder shell
22 Groove (identified in an exemplary manner)
23 Web (identified in an exemplary manner)
25 Interior of the cylinder shell 20
31 Cap
32 Cap
34 Weld seam
35 Radial inner side
36 Radial outer side
37 Central cap opening
38 Manhole
41 Journal
42 Journal
50 Inner shaft
51 Inner-shaft part
52 Inner-shaft part
53 Inner-shaft connection
60 Hollow shaft
61 Hollow-shaft part
62 Hollow-shaft part
63 Hollow-shaft connection
64 Central hollow-shaft opening

65 Interior of the hollow shaft 60
67 Cap-connection flange
68 Cap-connection flange
69 Inner wall
70 Cylinder
71 Part-cylinder
72 Part-cylinder
H Extent

The invention claimed is:

1. A large-cylinder drying roller, comprising:

a cylindrical cylinder shell having two sides;

two caps each being attached to a respective one of said sides of said cylinder shell;

two journals each being provided on a respective one of said caps;

an inner shaft coaxially disposed within said cylinder shell and connecting said journals to said caps, said inner shaft being a hollow shaft divided into at least two hollow-shaft parts and having an interior;

a hollow-shaft connection being accessible from said interior of said hollow shaft;

at least one of:

(i) said two hollow-shaft parts being interconnected or interconnectable by said hollow-shaft connection or (ii) said two hollow-shaft parts each having a cap-connection flange for connecting to one of said caps on an axial side thereof being opposite said hollow-shaft connection; and at least one of:

one of said hollow-shaft parts having a part-portion with functional groups all being disposed within said cylinder shell and radially disposed within an axially extending part-cylinder defined by said cap-connection flange or said hollow shaft having a portion with functional groups all being disposed within said cylinder shell and radially disposed within an axially extending cylinder defined by said two cap-connection flanges.

2. The large-cylinder drying roller according to claim 1, wherein at least one of said hollow-shaft parts is closed off by one of said journals.

3. The large-cylinder drying roller according to claim 1, wherein at least one of said hollow-shaft parts has an inner wall being a component part of said hollow-shaft connection.

4. The large-cylinder drying roller according to claim 1, wherein said caps each have a radial inner side and a radial outer side, and at least one of said caps has a radial extent, extending from said radial inner side to said radial outer side, of between 600 mm and 1100 mm.

5. The large-cylinder drying roller according to claim 1, wherein said caps each have a radial inner side and a radial outer side, and at least one of said caps has a radial extent, extending from said radial inner side to said radial outer side, of between 650 mm and 1000 mm.

6. The large-cylinder drying roller according to claim 1, wherein said hollow shaft has at least one axial wall, and a manhole is provided in at least one of at least one of said caps or said at least one axial wall of said hollow shaft.

* * * * *